US008144067B2

(12) United States Patent
Vogler

(10) Patent No.: US 8,144,067 B2
(45) Date of Patent: Mar. 27, 2012

(54) COMBINATION PLANAR AND PARABOLIC REFLECTOR ANTENNA TO ACCESS SATELLITE

(76) Inventor: James W Vogler, Phoenix, AZ (US)

( * ) Notice: Subject to any disclaimer, the term of this patent is extended or adjusted under 35 U.S.C. 154(b) by 393 days.

(21) Appl. No.: 12/583,124

(22) Filed: Aug. 14, 2009

(65) Prior Publication Data

US 2011/0037671 A1 Feb. 17, 2011

(51) Int. Cl.
*H01Q 3/00* (2006.01)

(52) U.S. Cl. ..... 343/757; 343/766; 343/781 P; 342/359

(58) Field of Classification Search ..... 343/757, 343/765, 766, 781 P; 342/359
See application file for complete search history.

(56) References Cited

U.S. PATENT DOCUMENTS

| | | | | |
|---|---|---|---|---|
| 3,407,404 | A * | 10/1968 | Cook et al. | 343/765 |
| 5,398,035 | A * | 3/1995 | Densmore et al. | 343/713 |
| 5,835,057 | A * | 11/1998 | van Heyningen | 342/359 |
| 6,043,788 | A * | 3/2000 | Seavey | 343/781 CA |
| 6,087,985 | A * | 7/2000 | Rummeli et al. | 342/359 |
| 6,861,994 | B2 * | 3/2005 | Desargant et al. | 343/765 |
| 7,492,323 | B2 * | 2/2009 | Nielsen | 343/757 |

* cited by examiner

*Primary Examiner* — Tho G Phan
(74) *Attorney, Agent, or Firm* — Tod R. Nissle, P.C.

(57) ABSTRACT

A portable satellite tracking antenna utilizes a tiltable reflector surface, and a parabolic reflector surface to direct a satellite signal to a feed horn. A fixed flat reflector surface is utilized in conjunction with the parabolic reflector surface to increase the strength of a signal that is transmitted from the parabolic reflector surface to the feed horn. In one preferred embodiment the parabolic reflector surface is fixed, and the feed horn and tiltable reflector surface are rotatable to selected azimuth settings. The cant of the tiltable reflector surface is adjusted by pivoting the tiltable reflector surface.

1 Claim, 5 Drawing Sheets

COMBINATION PLANAR AND PARABOLIC REFLECTOR ANTENNA TO ACCESS SATELLITE

This invention relates to satellite communication antennas.

More particularly, the invention relates to an improved communication antenna which utilizes planar and parabolic signal-reflecting surfaces to receive and transmit signals to a satellite and the means to automatically acquire and track a satellite in a mobile environment.

In another respect, the invention relates to an improved communication antenna which utilizes a secondary planar signal-reflective surface in conjunction with a parabolic signal-reflecting surface to strengthen the signal received by the antenna.

In a further respect, the invention relates to an improved communication antenna which utilizes a wide frequency bandwidth encompassing both up and down link frequencies.

A long existing motivation in the field of satellite communication is to provide a compact portable antenna which can be automatically positioned to communicate with a satellite that is in orbit above the earth. In a mobile environment, the ability of the antenna to align itself to a specific satellite is highly desirable. In this situation, there is little difference between a geosynchronous orbit or a constantly moving satellite since the antenna itself can be in motion. Existing antenna systems typically are relatively large structures that do not facilitate repeated movement of the antenna systems.

Accordingly, it would be highly desirable to provide an improved satellite communication system.

Therefore it is a principal object of the invention to provide an improved antenna to communicate with satellites.

A further object of the invention is to provide a compact, portable, self-aligning, relatively light weight antenna to communicate with satellites in orbit above the earth.

These and other, further and more specific objects of the invention will be apparent to those skilled in the art from the following detailed description thereof, taken in conjunction with the drawings, in which.

Figure 1:
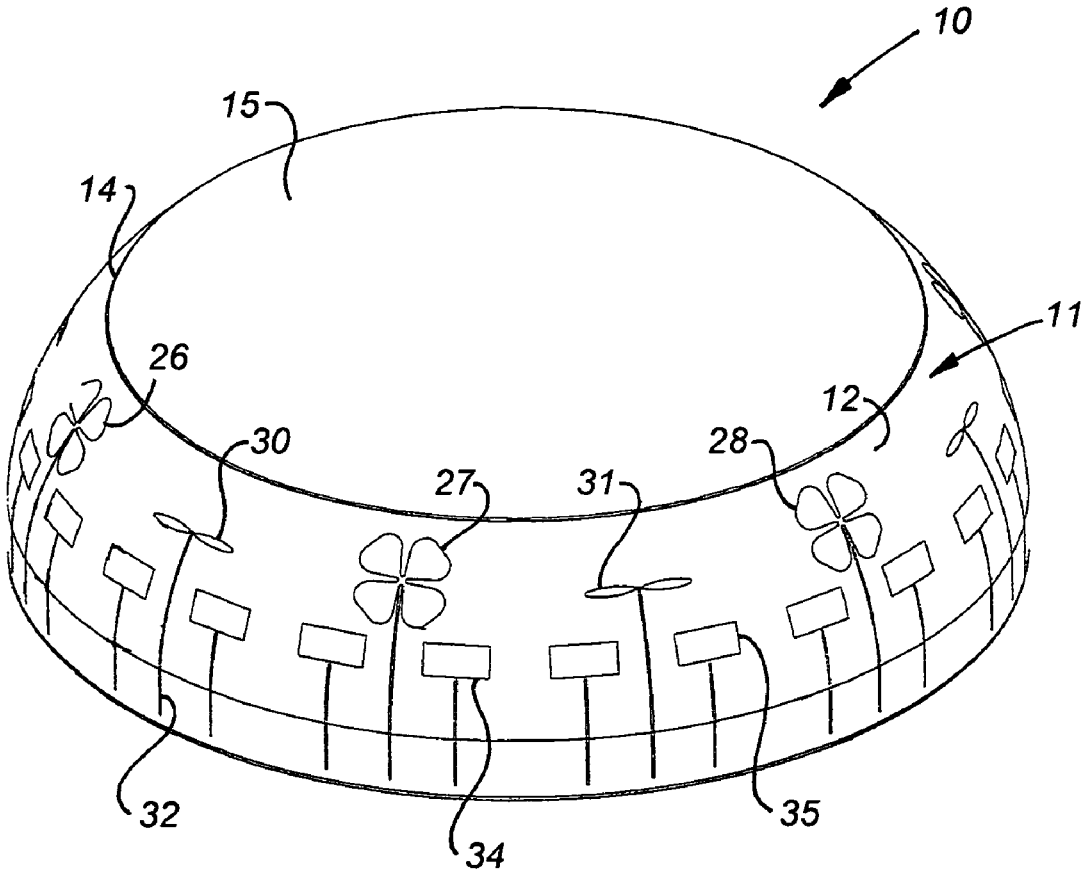
FIG. 1 is a perspective view illustrating an antenna constructed in accordance with the invention.

Briefly, in accordance with the invention, I provide an improved satellite tracking antenna. The antenna comprises a stationary housing including an arcuate wall circumscribing an inner volume and having an outer surface and an inner surface, a dielectric dome, and a plurality of GPS antennas formed and spaced apart on the periphery of the outer surface to generate differential location signals to determine the actual location and orientation of said antenna; a rotatable interior base in the housing and including an upper surface and a lower surface; a feed horn mounted on the upper surface of the base; a first reflector pivotally adjustably mounted on the base and extending upwardly way from the base; a second curved concave reflector on one of a pair consisting of the inner surface of the arcuate wall, and an arcuate surface on and extending upwardly away from the base; a third reflector extending over the upper surface of the base, canted with respect to the first curved reflector, and intermediate the feed horn and the second curved reflector; a transmitter/receiver to receive signals from and transmit signals to a satellite via the first, second, and third reflectors; a first motor operatively associated with the base to position rotatably base at a selected azimuth; a second motor operatively associated with the first reflector to position pivotally the first reflector to a desired elevation angle with respect to the base; and, a control. The control includes a memory including the location of a plurality of geosynchronous satellites which can communicate with the antenna; can receive said location signals and select one of the geosynchronous satellites with which to communicate; and, can operate the first and second motors to position the base and the first reflector to receive and transmit signals to and from the selected one of the geosynchronous satellites.

Turning now to the drawings, which depict the presently preferred embodiments of the invention for the purpose of illustration thereof, and not by way of limitation of the invention, and in which like characters refer to corresponding elements throughout the several views, FIGS. 1 to 4 illustrate an antenna constructed in accordance with the principles of the invention, and generally indicated by reference character 10.

Antenna 10 includes a housing. The housing includes outer upstanding arcuate wall 11 including outer surface 12 and inner surface 13. Inner surface 13 includes a reflective surface 42 formed thereon. Surface 42 can comprise metal or any other desired radio frequency reflective material that will reflect the particular radio frequency being utilized. The housing also includes a circular stationary bottom panel 25 and includes a dielectric dome, or top, 15 which has a circular peripheral edge 16 that seats on and is secured to the upper circular edge 14 of wall 11. Dome 15 is devoid of radio frequency reflective material and is transparent to radio frequency waves. Circular rotatable panel-shaped base 20 (FIG. 2) includes upper planar generally flat surface 21. Neck 22 is fixedly secured to and depends downwardly from base 20, and, is pivotally attached to bottom interior panel 25.

The space intermediate base 20 and bottom panel 25 functions as an equipment bay 26A.

Figure 2:
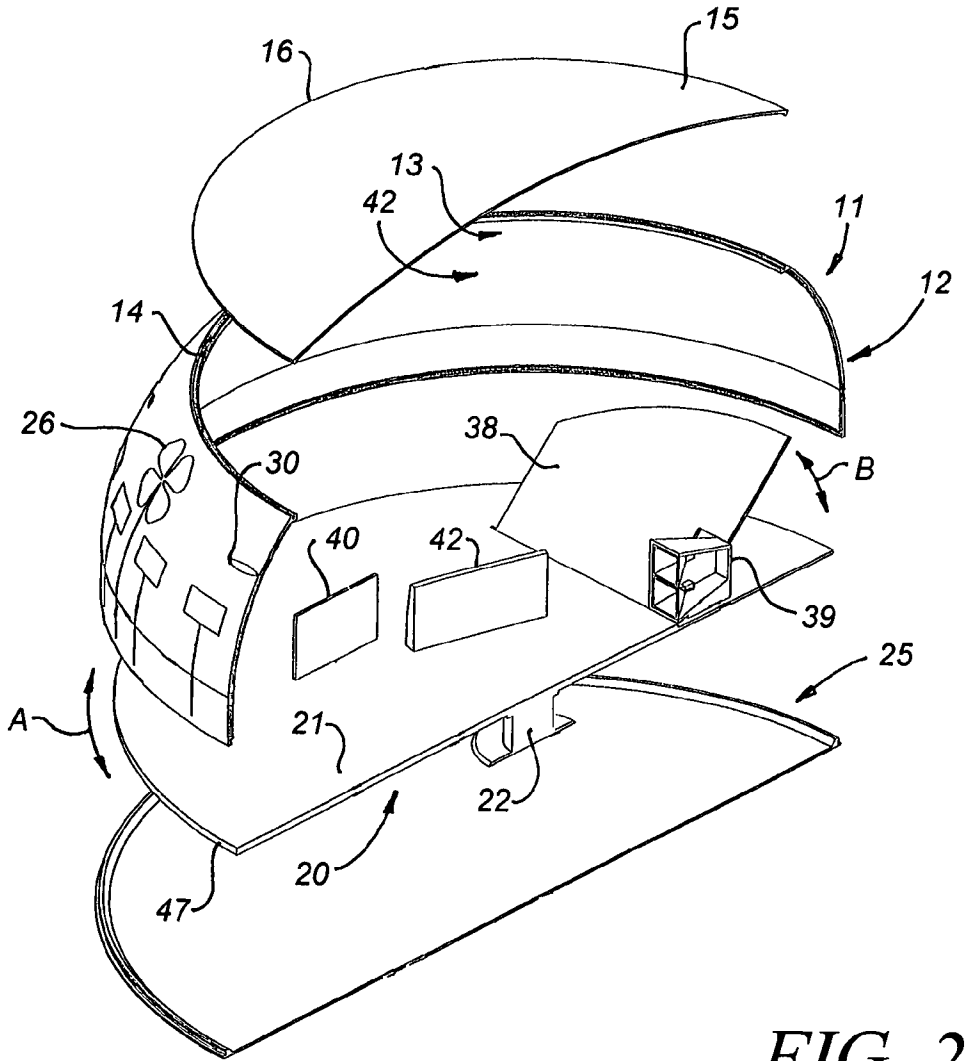
FIG. 2 is an exploded section perspective view of the antenna of FIG. 1 illustrating construction details thereof.
Figure 3:
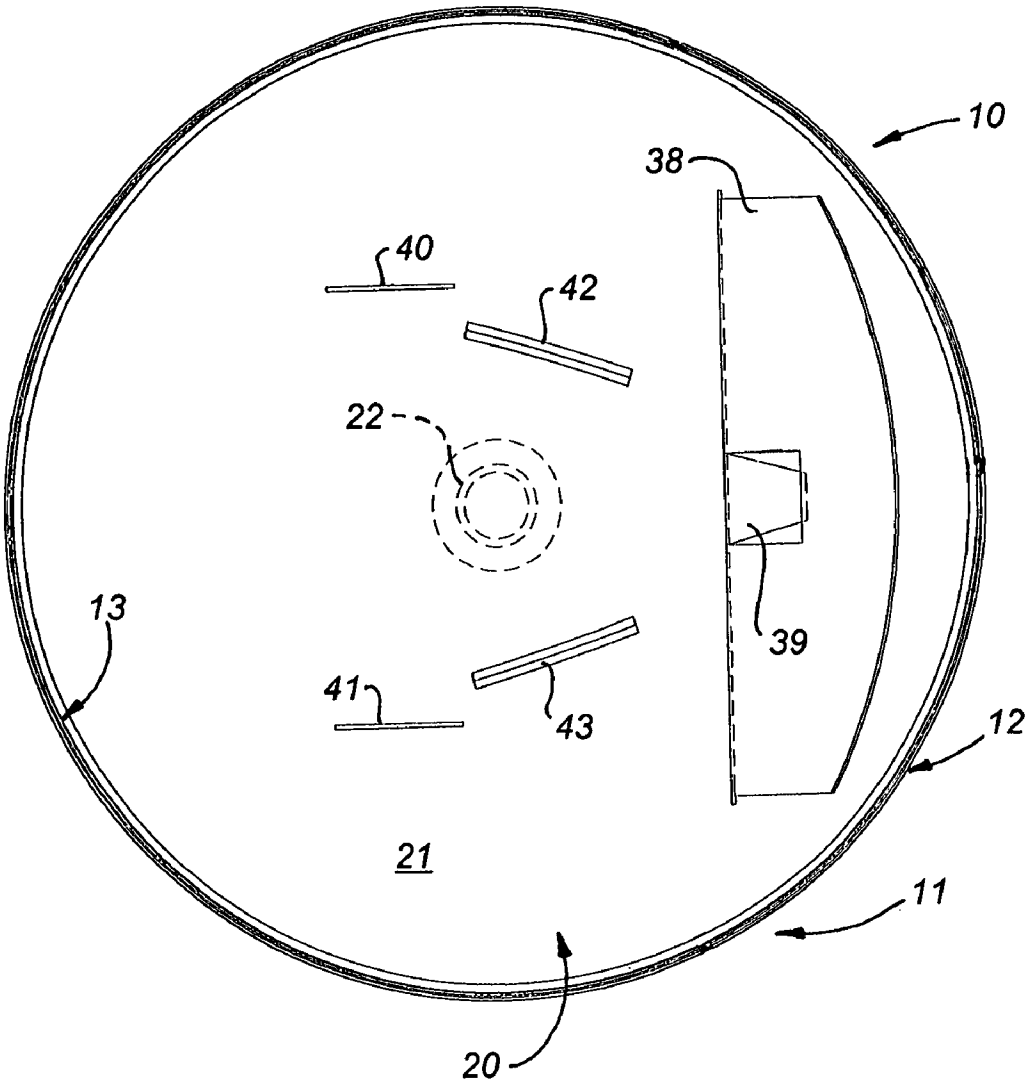
FIG. 3 is a top view of the rotatable base of the antenna of FIG. 1 further illustrating construction details thereof.
Figure 4:
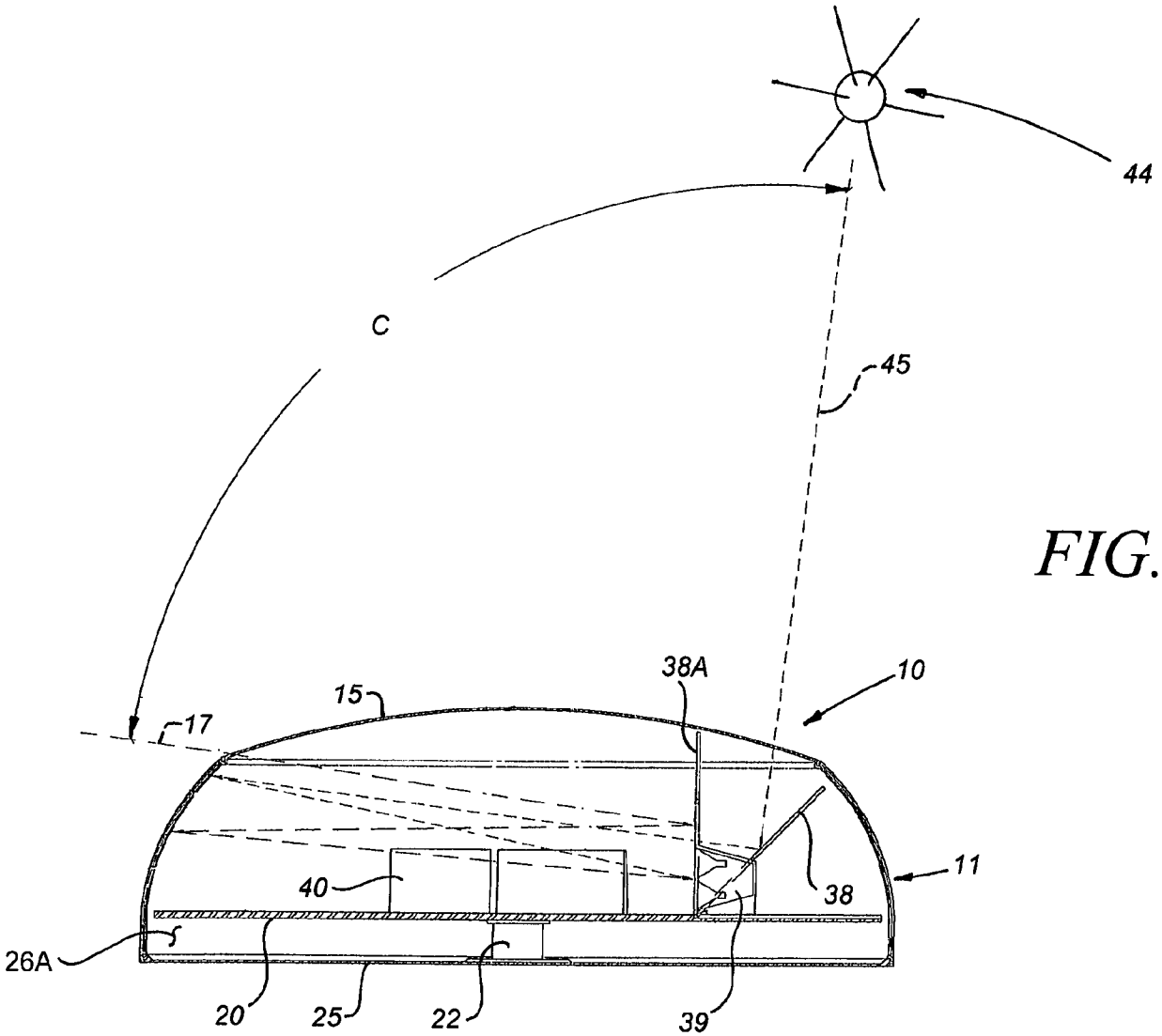
FIG. 4 is a side section view of the antenna of FIG. 1 illustrating the mode of operation thereof; and, FIG. 5 is a block diagram further illustrating the operation of the antenna of FIG. 1.
Figure 5:
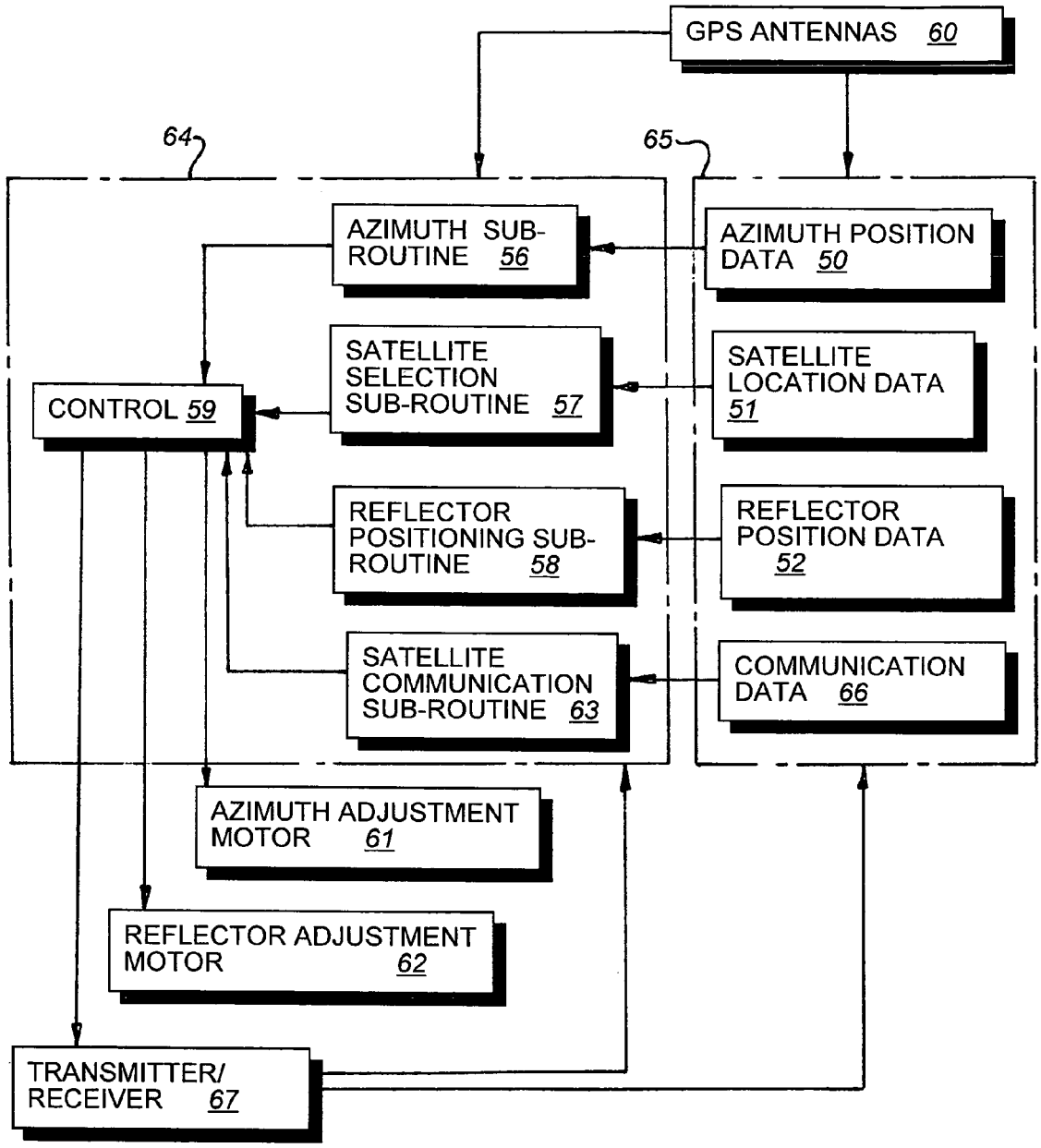

Neck 22 is mounted in bay 26A and operatively associated with azimuth adjustment motor 61 (FIG. 5; not visible in FIGS. 2 and 4). Motor 61 is mounted in bay and adjusts the azimuth position of base 20 by rotating neck 22 and base 20 in the directions indicated by arrows A. Neck 20 is hollow such that wiring can extend from the equipment bay 26A through neck 20, and to equipment on the base 20. Alternatively, wiring can extend intermediate the wall 11 and the outer peripheral edge of base 20.

Three or more triangulation GPS location antennas 26, 27, 28, 60 are formed at generally equally spaced, or other, intervals on the outer surface 12 of wall 11. Antennas 26, 27, 28 60 are sufficient in number and spacing to detect a signal incoming from any direction, including, without limitation, signals traveling in directions of travel generally parallel to the earth's surface A plurality of equally spaced patch antennas 34, 35 are formed on the outer surface 12 of wall 11 for 0.9 to 1.8 GHz and 5.6 GHz applications. A plurality of WiFi antennas 30, 31 are formed on the outer surface 12 of wall 11 for 1.2 to 5.6 GHz applications. Each antenna includes an electrical trace or connection 32.

If desired, metal reflectors 40, 41 and dielectric lens 42, 43 can be mounted on base 20 to facilitate the formation of a beam received or transmitted by feed horn 39.

If desired, two feed horns 39 can be utilized instead of a single feed horn. One feed horn transmits signals and the other receives signals. In one such configuration, a first feed horn is mounted inside and at the center of a second feed horn. The first centralized feed horn receives the highest frequency (shorter wavelength) signal, for example a thirty GHz uplink signal; and, the second feed horn receives a lower frequency (longer wavelength) signal, for example a twenty Ghz downlink signal. The uplink signal needs to be more precise; consequently, a higher frequency signal and the centralized feed horn are utilized. A higher frequency signal produces more gain and a narrower antenna pattern, which requires that the antenna be steered more accurately.

The upper surface 21 of base 20 can be provided with a radio frequency—reflective covering to strengthen an incoming signal that is reflected off metal surface 42 and into feed horn 39. Some of the radio frequency signal reflected off surface 42 toward horn 39 is also reflected off the reflective covering on generally flat upper surface 21 and toward horn 39.

In FIG. 4, angle C is the angle between an incoming signal 17 when tiltable flat reflector 38 is in a vertical position indicated by reference character 38A, and an incoming signal 45 indicated by reference character 45 when reflector is in the position illustrated in FIG. 4. Each incoming signal 17, 45 is reflected off surface 42 and into feed horn 39.

Surface 42 (and inner surface 13) is spherical along its intersection with a horizontal plane and is parabolic along its intersection with a vertical plane.

Reflector 38 is operatively associated with reflector adjustment motor 62 (FIG. 5; not visible in FIGS. 2 and 4). Motor 62 (FIG. 5) is mounted in equipment bay 26A and pivotally adjusts the reflector 38 in the directions indicated by arrows B in FIG. 2.

A transmitter/receiver 67 (FIG. 5) is mounted in equipment bay 26A and receives signals from antennas 26-28, 30, 31, 34, 35, feed horn 39, and controller 64 (FIG. 5).

A microprocessor or other control unit is mounted in equipment bay 26A. As is illustrated in FIG. 5, the control unit includes a controller 64 and member 65. Memory 65 can be a hard drive, paper tape, punched cards, or any other desired memory system. Memory 65 includes azimuth position data 50, satellite location data 51, reflector position data 52, and communication data 66.

Controller 64 includes azimuth sub-routine 56, satellite selection sub-routine 57, reflector positioning sub-routine, and satellite communication sub-routine 63. The GPS antennas 26 to 28 provide latitude and longitude data that enables the azimuth sub-routine 56 to determine the azimuth along which horn 39 and reflector 38 lie. The azimuth position data 50 includes the actual azimuth along which the reflector 38 and feed horn 39 lie, and includes the desired azimuth position of reflector 38 and feed horn 39 necessary for antenna 10 to communicate with a particular geosynchronous or non-geosynchronous satellite.

The satellite location data includes data defining the location of a plurality of geosynchronous or non-geosynchronous satellites. The satellite selection sub-routine 57 compares this data to the actual current location of antenna 10 (as provided by the GPS antennas 60) to determine which satellite is located closest to and can best communicate with antenna 10. Sub-routine 57 can also take into account whether reflector 38 is capable of being positioned to receive a signal from a satellite once the azimuth of base 20 is adjusted in one of the directions indicated by arrow B in order to align feed horn 39 in a vertical plane that passes through horn 39 and the satellite. Once this determination is made, the azimuth sub-routine 56 automatically determines the amount by which base 20 must be rotated in one of the directions indicated by arrows A (FIG. 2) in order to align and position feed horn 39 and reflector 38 to receive signals from and transmit signals to a selected satellite 44, and, determine the amount by which reflector 38 must be pivoted in one of the directions indicated by arrows B (FIG. 2) in order to position reflector 38 to receive signals from the selected satellite 44. Control 59 then commands the azimuth adjustment motor 61 and the reflector adjustment motor 62 (FIG. 62) to move base 20 and reflector 38 to the necessary positions.

Satellite location data 51 also identified the satellite with which antenna 10 is currently communicating.

Reflector position data 52 includes the current position of reflector 38, as well as any destination location that has recently been determined by reflector positioning sub-routine 58 and to which the reflector is currently being pivotally moved.

Communication data 66 includes data that is received by antenna 10 in a signal 45 from a satellite, and includes data that is to be transmitted or is being transmitted to satellite 10.

Coating upper surface 21 with a reflective material, polishing surface 21, or otherwise treating surface 21 to make it reflect incoming signals 45 into feed horn 39 is important because when signal energy reflected off surface 21 toward feed horn 39 is combined with signal energy reflected off surface 42 directly toward and into feed horn 39, the signal received by feed horn 39 "looks larger" and is stronger.

As would be appreciated by those of skill in the art, instead of forming a reflective surface 42 on inner surface 13, an upstanding arcuate surface comparable to arcuate surface 13 can be fixedly attached to surface 21 of base 20 and circumscribe base 20—preferably at or near the peripheral edge 47 of base 20. Such an upstanding arcuate surface can be provide with a reflective surface comparable to surface 42, would function in the same manner as surface 42, and would, instead of being stationary like surface 13, rotate simultaneously with base 20.

The data received by antenna 10 from a satellite can be transmitted by antenna 10 to a television, computer, or any other desired location. Auxiliary antennas 26-28, 30, 31, 34, 35 and/or transmitter/receiver 67 can, if desired, be utilized to transmit data from antenna 10 to any desired azimuth location.

Motors 61 and 62 and transmitter receiver 67 ordinarily are located in equipment bay 26 and may, or may not, rotate simultaneously with base 20.

The frequency range of the antenna 10 is performance limited on the low frequency end by the allowable beam width (beam width increases as the frequency is lowered) for a given physical size antenna. Antenna 10 is, however, scalable to another frequency by changing the physical dimensions proportional to the desired operational wavelength. The overall pattern is somewhat elliptical in that the horizontal beam width is narrower than the vertical beam width because of the aspect ratio of the reflector antenna. The net effect of this is that the vertical angle of the planar reflector angle is a bit less critical than the azimuth position.

Another property of antenna 10 is that it allows for a somewhat truncated feed horn 39 design since the inner rotating platform (i.e., upper surface 21) can be utilized as a mirror reflector to reflect signals into the feed horn 39 although this is only true for horizontal polarization. The curved reflector surface 42 is, as noted, parabolic in a vertical plane and spherical in a horizontal plane. While the ideal shape of the curved reflector would be parabolic in both planes, the deviation from the ideal parabolic curve in the horizontal dimension is small for a large radius relative to wavelength and can be compensated for by perturbating the wave front at the edge of the feed horn by utilizing a dielectric lens or loading. The gain of a reflective antenna is proportional to the effective surface area in wavelengths of the principal reflector. The shorter the wavelength (higher frequency), the higher the reflective gain at a gain slop of 6 decibels/octave or 20 decibels/decade.

One important feature of the invention is the utilization of a plurality of antennas about the outer peripheral face of the reflective antenna of the invention. These antennas permit a signal to be transmitted (or received) in any desired direction to facilitate the positioning of the antenna for reflective communication with a satellite. While antenna arrays are well known, the use of the antenna array of the invention in a reflective antenna communication system apparently has not be achieved, particularly in a tracking antenna system including adjustable rotatable and reflective components.

The trace 32 (FIG. 1) of each antenna 26 to 31 is connected to the inner reflective metal surface 17 to produce a potential between trace 32 and surface 17. Wall 11 comprises a dielectric. Antennas 26 to 31 are formed on wall 11, as is reflective surface 17. The thickness of wall 11 (i.e., the distance through wall 11 from an antenna 26 to 31 or tail 32 to surface 17) is in the range of ten mils to 100 mils. Each antenna 26 to 31 must be relatively close to surface 17.

In an alternate embodiment of the invention, a pair of spaced apart interconnected traces 32 is operatively associated with each individual antenna 26 to 31, and the potential generated between the pair of traces drives the antenna.

The power to operate the antenna 10 of the invention can be provided by a battery(s), solar panels, or any other desired power source.

In the event that GPS signal(s) are not available, the antenna can be manually positioned in a known azimuth position and the targeting computer can position the antenna normally. This provides potential for stationary implementations of the system. When the system is in a permanent fixed location or is moved between selected fixed locations, the location of the antenna at a fixed location can be set by compass and latitude/longitude.

Having described the invention and presently preferred embodiments and the best modes thereof in such terms as to enable one of skill in the art to make and use the invention, I claim:

1. A satellite tracking antenna comprising (a) a stationary housing including (i) an arcuate wall circumscribing an inner volume and having an outer surface and an inner surface, (ii) a dielectric dome, a plurality of GPS antennas formed and spaced apart on said outer surface to generate differential location signals to determine the actual location of said antenna, (b) a rotatable base in said housing and including an upper surface and a lower surface;

(c) at least one feed horn mounted on said upper surface of said base;

(d) a first reflector pivotally adjustably mounted on said base and extending upwardly way from said base;

(e) a second concave curved reflector on one of a pair consisting of (i) said inner surface of said arcuate wall, and (ii) an arcuate surface extending upwardly from said upper surface of said rotatable base;

(f) a third reflector extending over said upper surface of said base, canted with respect to said second curved reflector, and intermediate said second curved reflector and said feed horn;

(g) a transmitter/receiver to receive signals from and transmit signals to a satellite via said first, second, and third reflectors;

(h) a first motor operatively associated with said base to position said base at a selected azimuth;

(i) a second motor operatively associated with said third reflector to position said reflector at a desired angle with respect to said base;

(j) a control (i) with a memory including the location of a plurality of geosynchronous satellites which can communicate with said antenna, (ii) to receive said location signals and select one of said geosynchronous satellites with which to communicate, and (iii) to operate said first and second motors to position said base and said first reflector such that the antenna receives and transmits signals to and from said one of said geosynchronous satellites.

* * * * *